US009551956B2

(12) United States Patent
Abe et al.

(10) Patent No.: US 9,551,956 B2
(45) Date of Patent: Jan. 24, 2017

(54) IMAGE FORMING APPARATUS THAT UTILIZES TONER ROLLER BIAS VOLTAGES FOR IMAGE DENSITY ADJUSTMENTS

(71) Applicants: Kyoko Abe, Osaka (JP); Yuji Nagatomo, Osaka (JP); Shintaro Yamada, Osaka (JP); Shinji Aoki, Osaka (JP)

(72) Inventors: Kyoko Abe, Osaka (JP); Yuji Nagatomo, Osaka (JP); Shintaro Yamada, Osaka (JP); Shinji Aoki, Osaka (JP)

(73) Assignee: Ricoh Company, Ltd., Toyko (JP)

( * ) Notice: Subject to any disclaimer, the term of this patent is extended or adjusted under 35 U.S.C. 154(b) by 0 days.

(21) Appl. No.: 14/997,264

(22) Filed: Jan. 15, 2016

(65) Prior Publication Data

US 2016/0209774 A1 Jul. 21, 2016

(30) Foreign Application Priority Data

Jan. 21, 2015 (JP) ..... 2015-009386
Dec. 7, 2015 (JP) ..... 2015-238644

(51) Int. Cl.
*G03G 15/06* (2006.01)
*G03G 15/00* (2006.01)

(52) U.S. Cl.
CPC ..... *G03G 15/065* (2013.01); *G03G 15/5041* (2013.01); *G03G 2215/00569* (2013.01)

(58) Field of Classification Search
CPC ..... G03G 15/065; G03G 15/0808; G03G 15/5041
See application file for complete search history.

(56) References Cited

U.S. PATENT DOCUMENTS

2002/0037175 A1* 3/2002 Nakazato ..... G03G 15/065 399/49
2007/0189812 A1 8/2007 Murayama et al.
(Continued)

FOREIGN PATENT DOCUMENTS

JP 11-305501 11/1999
JP 2002-156826 5/2002

*Primary Examiner* — David Gray
*Assistant Examiner* — Laura Roth
(74) *Attorney, Agent, or Firm* — Duft Bornsen & Fettig LLP

(57) ABSTRACT

An image forming apparatus is provided. The image forming apparatus includes a photoconductor, an irradiator, a developing device including a developing roller, a development bias applying device, a toner supplying roller and a supply bias applying device, and a controller. The controller changes supply bias offset by reference to at least one of five parameters including photoconductor travel distance, operation temperature of the developing device, operation humidity of the developing device, continuous operating time of the developing device, and color information of image to be produced. After changing the supply bias offset, the controller forms plural toner patterns for image density adjustment on the photoconductor by changing the development bias, and sets the development bias to a certain bias based on the image densities of the plural toner patterns so that the image produced by the developing device has a targeted image density.

9 Claims, 8 Drawing Sheets

(56) References Cited

U.S. PATENT DOCUMENTS

| | | | | |
|---|---|---|---|---|
| 2008/0267641 | A1 | 10/2008 | Konishi et al. | |
| 2009/0041512 | A1 | 2/2009 | Murayama et al. | |
| 2009/0208252 | A1 | 8/2009 | Nakagawa et al. | |
| 2010/0303486 | A1* | 12/2010 | Shibata ..... | G03G 15/0808 399/43 |
| 2014/0161471 | A1 | 6/2014 | Matsuno et al. | |

* cited by examiner

FIG. 3C

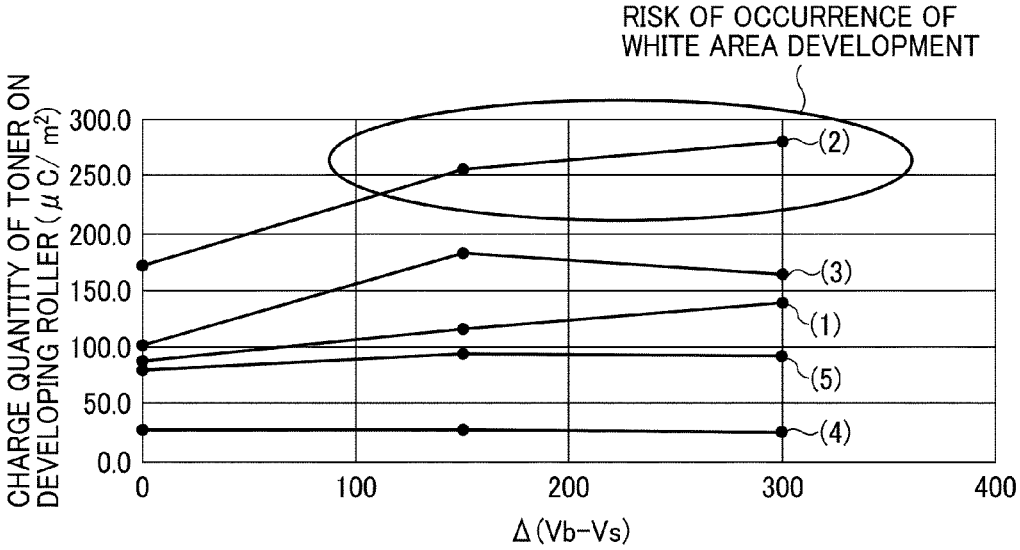

| LINE | PHOTOCONDUCTOR TRAVEL DISTANCE (m) | MACHINE PRESERVATION/OPERATION CONDITION, AND EVALUATION CONDITION |
|---|---|---|
| (1) | 0 | AFTER MACHINE IS LEFT IN HIGH TEMPERATURE / HIGH HUMIDITY ENVIONMENT, EVALUATION IS PERFORMED IN HIGH TEMPERATURE / HIGH HUMIDITY ENVIONMENT |
| (2) | 0 | AFTER MACHINE IS LEFT IN LOW TEMPERATURE / LOW HUMIDITY ENVIONMENT, EVALUATION IS PERFORMED IN LOW TEMPERATURE / LOW HUMIDITY ENVIONMENT |
| (3) | 0 | EVALUATION IS PERFORMED WHEN MACHINE IS OPERATED IN LOW TEMPERATURE / LOW HUMIDITY ENVIONMENT |
| (4) | 5000 | EVALUATION IS PERFORMED WHEN MACHINE IS OPERATED IN HIGH TEMPERATURE / HIGH HUMIDITY ENVIONMENT |
| (5) | 5000 | EVALUATION IS PERFORMED WHEN MACHINE IS OPERATED IN LOW TEMPERATURE / LOW HUMIDITY ENVIONMENT |

IMAGE FORMING APPARATUS THAT UTILIZES TONER ROLLER BIAS VOLTAGES FOR IMAGE DENSITY ADJUSTMENTS

CROSS-REFERENCE TO RELATED APPLICATIONS

This patent application is based on and claims priority pursuant to 35 U.S.C. §119 to Japanese Patent Applications Nos. 2015-009386 and 2015-238644, filed on Jan. 21, 2015 and Dec. 7, 2015, respectively, in the Japan Patent Office, the entire disclosure of which is hereby incorporated by reference herein.

BACKGROUND

Technical Field

This disclosure relates to an image forming apparatus.

Description of the Related Art

In general, electrophotographic image forming apparatus often cause a phenomenon such that due to deterioration of members of the developing device thereof and toner used for the developing device, mobility of the toner, which is imparted to the toner by the electric field formed between the toner supplying roller and the developing roller, deteriorates, thereby causing a problem (hereinafter referred to as a low density image problem or a faded image problem) such that the toner does not spread to the entire latent image area on the latent image bearer (such as photoconductor), resulting in formation of a low density toner image or a toner image having a low density area (i.e., faded image area) in the sub-scanning direction. In addition, when the environment surrounding the image forming apparatus (such as ambient temperature and humidity) changes or users change the image forming conditions of the image forming apparatus, the low density image problem tends to be caused.

In attempting to prevent occurrence of the problem, techniques such that by using a toner supplying roller characterized in property and configuration thereof or by properly controlling the bias (set value of bias) applied to a toner supplying roller, the power of the toner supplying roller to supply the toner to the developing roller is increased have been used. For example, there is a proposal in which by using the Paschen curve, the upper limit of the toner supply bias voltage is set to a voltage, at which discharge is not caused, to prevent formation of an image having uneven image density, which is formed due to abnormal electric discharge and leakage current. In addition, there is a proposal in which the ratio ($d/\in$) (i.e., equivalent dielectric thickness of the photoconductor) of the thickness of the photoconductor (d) to the specific dielectric constant ($\in$) of the photoconductor is set to 12 μm or less to prevent formation of background fouling.

There is another proposal concerning image forming method in which the supply bias is changed to produce high quality images even when the environmental conditions change. In this image forming method, an image pattern is formed at two or more positions of an electrostatic latent image bearer while changing the development bias, and the image densities of the image patterns are measured with an image density detector to determine the slope of the image density against the development bias, i.e., dependency of the image density on the development bias. The supply bias is changed based on the thus determined dependency to produce high quality images even when the environmental conditions change.

SUMMARY

As an aspect of this disclosure, an image forming apparatus is provided which includes a photoconductor to bear an electrostatic latent image thereon; an irradiator to irradiate the photoconductor to form the electrostatic latent image; a developing device to develop the electrostatic latent image with a toner serving as a one component developer to form a toner image on the photoconductor; and a controller. The developing device includes a rotatable developing roller which is arranged so as to face the photoconductor while bearing the toner thereon to feed the toner to the photoconductor to develop the electrostatic latent image with the toner; a development bias applying device to apply a development bias to the developing roller; a toner supplying roller to supply the toner to the developing roller; and a supply bias applying device to apply a supply bias to the toner supplying roller. The controller controls the development bias applying device and the supply bias applying device, and performs a development control including changing a supply bias offset, which is defined as a difference between the development bias and the supply bias, by reference to at least one of five parameters including photoconductor travel distance, operation temperature of the at least one developing device, operation humidity of the at least one developing device, continuous operating time of the at least one developing device, and color information of the toner image to be produced; then forming plural toner patterns for image density adjustment having different image densities on the photoconductor while changing the development bias; and setting the development bias to a certain bias based on the image densities of the plural toner patterns so that the toner image produced by the developing device has a targeted image density.

The aforementioned and other aspects, features and advantages will become apparent upon consideration of the following description of the preferred embodiments taken in conjunction with the accompanying drawings.

BRIEF DESCRIPTION OF THE SEVERAL VIEWS OF THE DRAWINGS

FIG. 3C is a graph showing the relationship between the supply bias offset and the charge quantity ($\mu C/m^2$) of toner on the developing roller;

DETAILED DESCRIPTION

Figure 1:
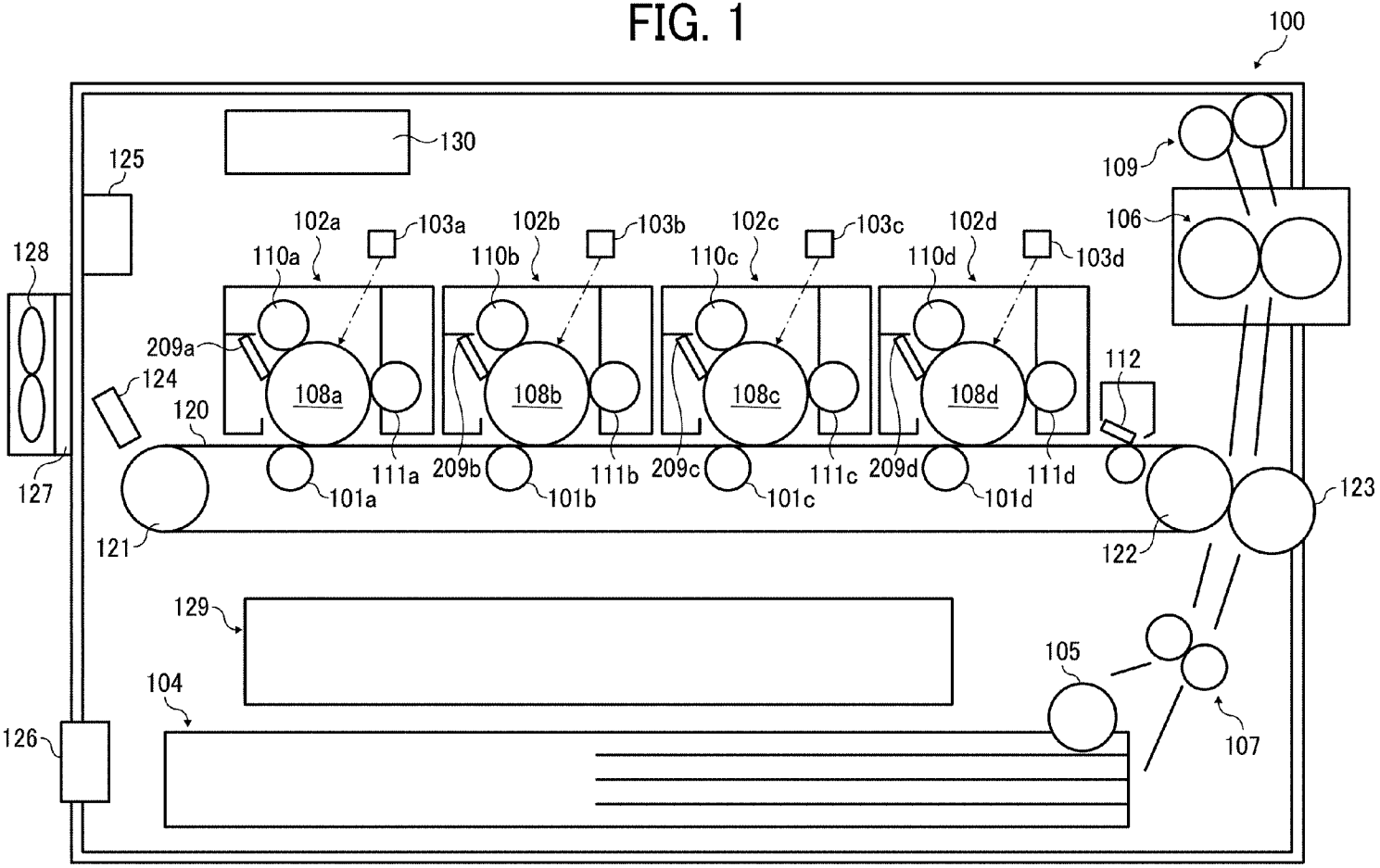
FIG. 1 is a schematic view illustrating an image forming apparatus according to an embodiment of this disclosure.

When only the power of the toner supplying roller to supply the toner to the developing roller is increased, another problem such that toner is adhered to non-image areas (i.e., background) of the image bearer is caused although occurrence of the low image density problem may be prevented. In the proposal first mentioned above, the equivalent dielectric constant is set to 12 μm or less to prevent formation of background fouling. As a result of the present inventors' investigation, it is found that occurrence of the "white area development" mentioned later cannot be prevented. In addition, when the thickness (d) of the photoconductor is decreased to decrease the equivalent dielectric constant (d/∈), the durability of the photoconductor tends to deteriorate.

As a result of the present inventors' investigation, it is found that the image forming method of the second-mentioned proposal cannot prevent occurrence of the problems, i.e., white area development and background fouling mentioned below.

Hereinafter, the problems (i.e., white area development and background fouling) which are caused when the toner supplying power is enhanced and which are phenomena such that toner is adhered to non-image areas will be described.

Specifically, when the toner supplying power is increased, the charge quantity of the toner born by the developing roller and the amount of the toner fed by the developing roller (hereinafter referred to as toner feed amount) also change. Due to these changes, the toner is adhered to non-image areas. The reasons therefor are the following.

(1) In a case in which the toner feed amount is increased and thereby the charge quantity of the toner is increased.

When the amount of toner fed to the developing roller (i.e., the toner feed amount) is increased, the charges of the toner are added to the development bias. As a result, the development bias (i.e., effective development bias) is increased to an extent such that the effective development bias exceeds the potential of non-image areas of the photoconductor, and thereby the white areas of a recording medium (such as paper) are soiled with the toner even when normal development is performed. Hereinafter, this phenomenon is referred to as "white area development."

(2) In a case in which the toner feed amount is increased but the charge quantity of the toner is decreased.

When the toner fed to the developing roller is a mixture of old toner (i.e., deteriorated toner) and new toner, the toner often causes charge separation, thereby forming oppositely-charged toner particles and weakly-charged toner particles, even when the toner feed amount is increased. In this case, such toner particles (i.e., oppositely-charged toner particles or weakly-charged toner particles) are adhered to non-image areas (background) of the photoconductor, thereby soiling the white areas (background) of a recording medium (such as paper) with the toner. Hereinafter, this phenomenon is referred to as "background fouling."

In both the cases, not only abnormal images in which the background (white area) is soiled with the toner are produced, but also the consumption of the toner increases.

The object of this disclosure is to provide a developing device, which can prevent formation of such abnormal images as mentioned above (white area development and background fouling) while maintaining good toner supplying power.

Hereinafter, a developing device, and an image forming apparatus according to embodiments of this disclosure will be described by reference to drawings. In this regard, constituents (such as parts and devices) having the same functions or shapes have the same reference numbers, and after the constituents are explained once, explanation of the constituents is omitted.

(Image Forming Apparatus)

The configuration and operation of an image forming apparatus 100 according to an embodiment of this disclosure will be described by reference to FIG. 1. The image forming apparatus 100 is an electrophotographic tandem color printer. However, the image forming apparatus of this disclosure is not limited thereto, and can be another printer (such as monochromatic printers), a copier, a facsimile, and a multifunction peripheral having two or more functions such as printing, copying, and facsimileing.

Referring to FIG. 1, the image forming apparatus 100 includes four process units 102*a*-102*d* which are arranged side by side in the horizontal direction in a central portion of the main body thereof and which are detachably attachable to the main body.

The process units 102*a*, 102*b* and 102*c* are color process units to form cyan, magenta and yellow color images, respectively, and the process unit 102*d* is a black process unit to form black color images. These process units 102*a*-102*d* have the same configuration except that the developers (i.e., toners) thereof have different colors (i.e., cyan (C), magenta (M), yellow (Y) and black (K) toners). When a full color image is formed, visible images, i.e., K, Y, M and C toner images, are formed in this order by the process units 102*d*, 102*c*, 102*b* and 102*a*. Hereinafter, character a (cyan), b (magenta), c (yellow) and d (black) are added to the reference numbers as suffixes when it is necessary to specify one or more of the process units and members of the process units, but the suffixes are omitted when it is not necessary for description of the process units and the members.

An irradiator serving as a latent image forming device irradiates photoconductors 108*a*, 108*b*, 108*c* and 108*d* with light beams emitted by irradiators 103*a*, 103*b*, 103*c* and 103*d*, respectively, from above to form electrostatic latent images on the surfaces of the photoconductors. Specific examples of the irradiator include laser beam scanners using a laser diode, and light emitting diodes (LEDs).

An intermediate transfer belt 120 is arranged below the process units 102 so as to extend horizontally. The intermediate transfer belt 120 is looped over a driving roller 122 located on the right side and a tension roller 121 located on the left side. A predetermined tension is applied to the intermediate transfer belt 120 by a biasing force, which is applied to the tension roller 121 by an elastic member such as springs.

Four primary transfer rollers 101*a*, 101*b*, 101*c* and 101*d* are arranged inside the intermediate transfer belt 120 so as to contact the photoconductors 108*a*, 108*b*, 108*c* and 108*d*, respectively, with the intermediate transfer belt therebetween, thereby forming four primary transfer nips between the intermediate transfer belt 120 and the photoconductors 108. A transfer bias of from +400V to +2,500V are applied to each of the primary transfer rollers 101 to form primary transfer electric fields for the primary transfer nips.

The driving roller 122 located on the right side of the intermediate transfer belt 120 is contacted with a secondary transfer roller 123 with the intermediate transfer belt 120 therebetween, thereby forming a secondary transfer nip between the intermediate transfer belt 120 and the secondary transfer roller 123. A high-voltage power supply applies a transfer bias to the secondary transfer roller 123 to form a secondary transfer electric field for the secondary transfer nip. A fixing device 106 and a pair of ejection rollers 109 are arranged above the secondary transfer roller 123.

In addition, a toner mark sensor (hereinafter sometimes referred to as a TM sensor) 124 is arranged so as to face the peripheral surface of the tension roller 121 located on the left side of the intermediate transfer belt 120. The TM sensor 124 is constituted of a regular reflection type sensor or a diffusion type sensor. The TM sensor 124 detects the image densities and positions of color toner images on the intermediate transfer belt 120, and sends the detection results to a controller 130 of the image forming apparatus 100. The controller 130 may be provided for each of the process units 102. In this case, each process unit 120 is equipped with a memory table (mentioned later) corresponding to the color of images to be produced by the process unit.

An internal temperature and humidity sensor 125, an external temperature and humidity sensor 126, a filter 127, and a blast fan 128 are arranged at positions of the chassis near the TM sensor 124. The detection results of the temperature and humidity sensors 125 and 126 are sent to the controller 130 of the image forming apparatus 100. The controller 130 adjusts the image density and the color matching based on the detection results of the TM sensor 124, and the detection results of the temperature and humidity sensors 125 and 126. This adjustment operation is performed when development variable factors such as the number of prints produced, operating time of the developing device, and internal and external temperature and humidity reach the threshold values thereof.

Each of the photoconductors 108 is a photoconductor having a cylindrical form, and is rotated at a predetermined linear speed. A charger 110 (110*a*, 110*b*, 110*c* and 110*d*) having a roller form is contacted with the surface of the photoconductor 108 so as to be rotated while driven by the photoconductor 108. Since a DC bias or an AC-superimposed DC bias is applied to the charger 110 by a high voltage power supply, the surface of the photoconductor 108 is evenly charged. A developing roller 111 (111*a*, 111*b*, 111*c* and 111*c*) is arranged on the right side of the photoconductor 108. A predetermined development bias is applied to the developing roller 111 by a bias applying device 212 which has a high voltage power supply and which will be described later by reference to FIG. 2.

A sheet feeding tray 104 is arranged at the bottom of the image forming apparatus 100 to contain sheets of a recording medium therein. The recoding sheets in the sheet feeding tray 104 are picked up by a feeding roller 105 one by one so as to be fed to a pair of timing rollers 107. The thus fed recording sheet is timely fed by the pair of timing rollers 107 to the secondary transfer nip so that the toner image on the intermediate transfer belt 120 is transferred to a proper position of the recording sheet at the secondary transfer nip. Since the optimum image transfer condition under which a toner image on the intermediate transfer belt 120 is optimally transferred to the recording sheet at the secondary transfer nip changes depending on variables such as moisture content of paper used as the recording sheet, the controller 130 sets the optimum image transfer condition based on an image transfer current table including information on variables such as type of the recording sheet (paper), and the internal and external temperature and humidity which are detected by the internal and external temperature and humidity sensors 125 and 126.

(Image Forming Operation)

Next, the image forming operation of the image forming apparatus 100 will be described.

When an image forming operation starts, C, M, Y and K color images are formed in the process units 102*a*, 10*b*, 102*c* and 102*d*, respectively. Specifically, in each of the process units 102*a*, 10*b*, 102*c* and 102*d*, the photoconductor 108 is rotated, and the surface thereof is evenly charged by the charger 110 so as to have a charge with a predetermined polarity.

Next, the surface of the photoconductor 108 is irradiated with a light beam emitted by the irradiator 103, thereby forming an electrostatic latent image thereon. In this regard, light beams emitted by the irradiators 103*a*, 103*b*, 103*c* and 103*d* include C, M, Y and K color image information obtained by subjecting a full color image to be produced to color separation. The developing roller 111 supplies the color toner corresponding to the color image to the electrostatic latent image on the photoconductor 108, thereby developing (visualizing) the electrostatic latent image.

The C, M, Y and K color toner images thus formed on the photoconductors 108*a*, 108*b*, 108*c* and 108*d* are sequentially transferred to the intermediate transfer belt 120 so as to be overlaid, resulting in formation of a combined color toner image on the intermediate transfer belt. The toners remaining on the photoconductors 108 without being transferred to the intermediate transfer belt 120 are removed by a cleaner 209 (209*a*, 209*b*, 209*c* and 209*d*), and the collected toners (waste toners) are contained in a waste toner container 129.

The combined color toner image on the intermediate transfer belt 120 is transferred to the recording medium sheet, which has been fed from the sheet feeding tray 104, at the secondary transfer nip. The toners remaining on the intermediate transfer belt 120 without being transferred to the recording medium sheet are removed by a belt cleaner 112. The recording medium sheet passing the secondary transfer nip and bearing the combined color toner image thereon is fed to the fixing device 106, which fixes the combined color toner image to the recording medium sheet upon application of heat and pressure thereto. The recording medium sheet bearing the fixed color toner image thereon is ejected from the image forming apparatus 100 by the pair of ejection rollers 109. Thus, a series of image forming processes is completed.

Hereinbefore, the image forming operation of forming a full color image using the four process units 108 has been described. However, the image forming apparatus 100 can form monochromatic images (using one of the process units 102), and multi-color images including two or three color images (using two or three of the process units 102) as well as full color images.

(Process Unit)

Figure 2:
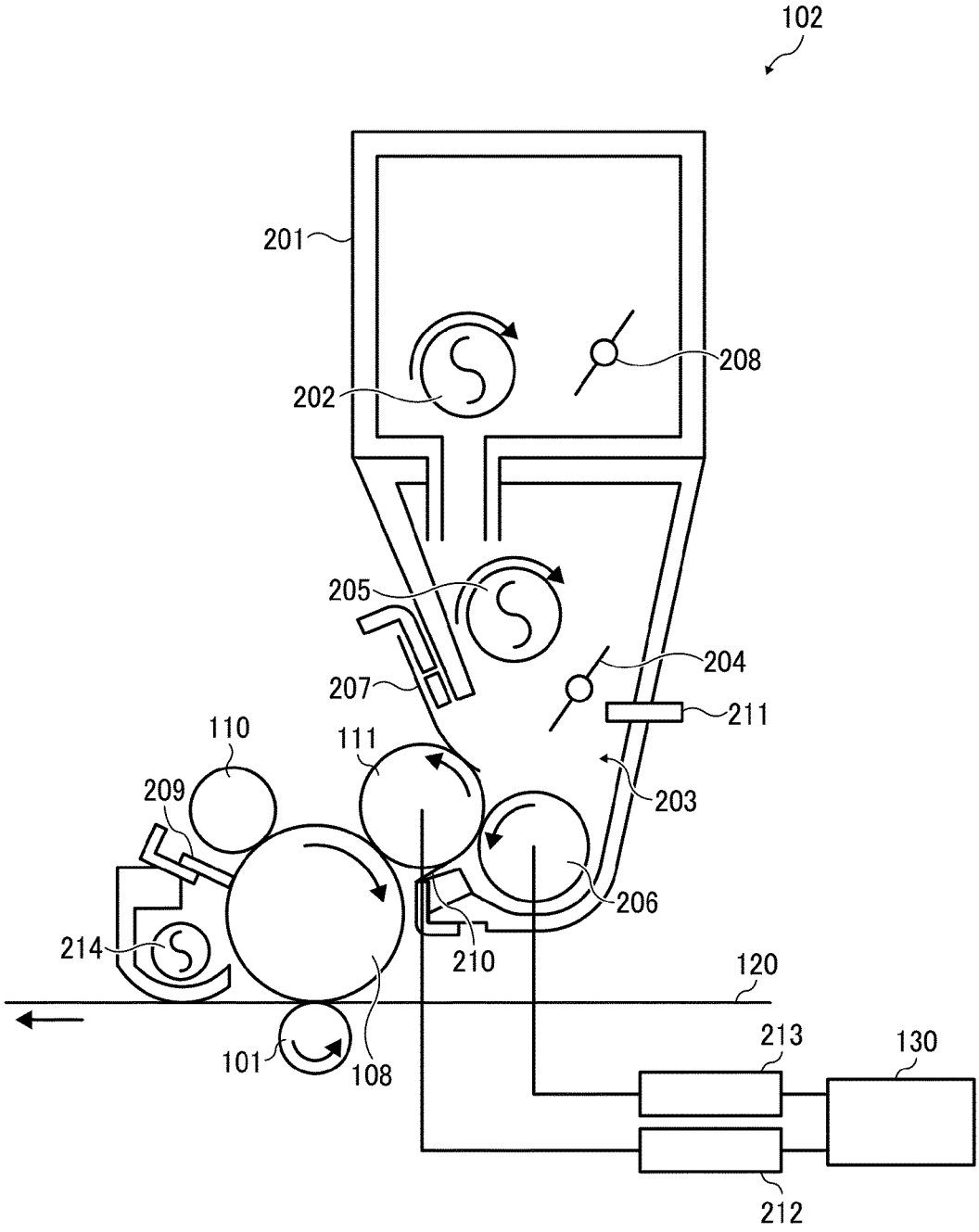
FIG. 2 is a schematic cross-sectional view illustrating a developing device of the image forming apparatus, which is a process unit.

FIG. 2 is a schematic view illustrating the process unit 102 serving as a developing device according to an embodiment of this disclosure. This process unit 102 includes a toner supply container 201 which is located in the upper part of the process unit 102 to contain new toner to be supplied, and a developing chamber 203 which is located in the lower part of the process unit 102 and which contains a predetermined amount of toner since the beginning. As illustrated in FIG. 2, it is preferable to arrange a stirring paddle 208 in the toner supply container 201, which stirs the toner usually to maintain the flowability of the toner.

In addition to the stirring paddle 208, a feeder 202 such as screws and coils is arranged in the toner supply container 201. The feeder 202 is connectable with a driver of the main body via an attaching/detaching mechanism such as crutches. The feeder 202 is driven if desired to supply the toner to the developing chamber 203. The amount of toner supplied to the developing chamber 203 can be controlled by changing the driving time of a driver in the main body of the image forming apparatus. In this regard, it is possible for the controller 130 to change the driving time depending on the flowability of the toner which changes, for example, when the ambient temperature and humidity change.

A toner transporter 205 such as screws is arranged in the developing chamber 203 to transport the toner, which is supplied from the toner supply container 201 to the developing chamber, in the longitudinal direction of the process unit 102. In addition, an agitator 204 is arranged adjacent to the toner transporter 205 to stir the toner in the developing chamber 203.

The upper surface of the toner present in the developing chamber 203 is detected by a residual quantity detector 211. Any one of light transmission sensors, piezoelectric sensors, and mechanical sensors can be used as the residual quantity detector 211. When the amount of toner present in the developing chamber 203 decreases to an extent such that the upper surface of the toner is below the detection surface of the residual quantity detector 211, the toner is supplied from the toner supply container 201 to the developing chamber 203.

A developing roller 111 serving as a toner bearer and a toner supplying roller 206 to supply the toner to the developing roller are arranged at the bottom of the developing chamber 203. The toner supplying roller 206 is mainly made of a sponge material. A development bias is applied to the developing roller 111 by the development bias applying device 212, and a supply bias is applied to the toner supplying roller 206 by a supply bias applying device 213. The development bias applying device 212 and the supply bias applying device 213 are controlled by the controller 130.

The developing roller 111 is arranged so as not to contact the photoconductor 108, namely, the developing roller develops the electrostatic latent image on the photoconductor 108 in a non-contact development manner using a toner. However, the developing roller 111 may be contacted with the photoconductor 108 to perform contact development.

The toner fed to the developing roller 111 by the toner supplying roller 206 is moved toward a regulating blade 207 as the developing roller rotates in a direction indicated by an arrow, and the regulating blade forms an even toner layer on the surface of the developing roller. The toner in the toner layer is adhered to the electrostatic latent image on the photoconductor 108 in such a manner that the amount of toner adhered to the electrostatic latent image changes depending on the surface potential of the electrostatic latent image, thereby forming a toner image on the photoconductor. Since the photoconductor 108 rotates in a direction indicated by an arrow, the toner image on the photoconductor is transferred to the intermediate transfer belt 120 at the primary transfer nip.

The toner remaining on the surface of the developing roller 111 without being transferred to the photoconductor 108 is returned to the development chamber 203 after rubbed by a toner leakage preventing sheet 210 which is arranged in a space in the vicinity of the surface of the developing roller.

The toner remaining on the surface of the photoconductor 108 without being transferred to the intermediate transfer belt 120 is removed therefrom by the cleaner 209, and the residual toner is fed to the waste toner container 129 (illustrated in FIG. 1) by a toner transporter 214.

(Operation of Developing Device)

The process unit 102 serving as a developing device according to an embodiment of this disclosure controls a difference Δ(Vb−Vs) (hereinafter referred to as a supply bias offset) between the bias Vb applied to the developing roller 111 (hereinafter referred to as a development bias Vb) and the bias Vs applied to the toner supplying roller 206 (hereinafter referred to as a supply bias Vs) so that the toner can maintain good developing roller following capability. By controlling the supply bias offset Δ(Vb−Vs), the amount and charge quantity of the toner fed to the developing roller 111 can be controlled. In this regard, when setting of the supply bias offset is performed, it is preferable to perform setting of various parameters so that the toner can have good developing roller following capability and occurrence of a problem such that the toner on the developing roller 111 is naturally transferred to the photoconductor 108 can be prevented.

In the image forming apparatus 100, changing of the supply bias offset is performed in combination with the image density adjustment. In this case, the print sequence (i.e., print job) is not performed. In addition, when the image density adjustment is performed, the timing of change in the supply bias offset is synchronized with the timing of change in the background potential. In this case, setting of the background potential is performed in consideration of the set value of the supply bias offset, the operation environment (temperature and humidity), and usage conditions of the developing device.

Figure 3A:
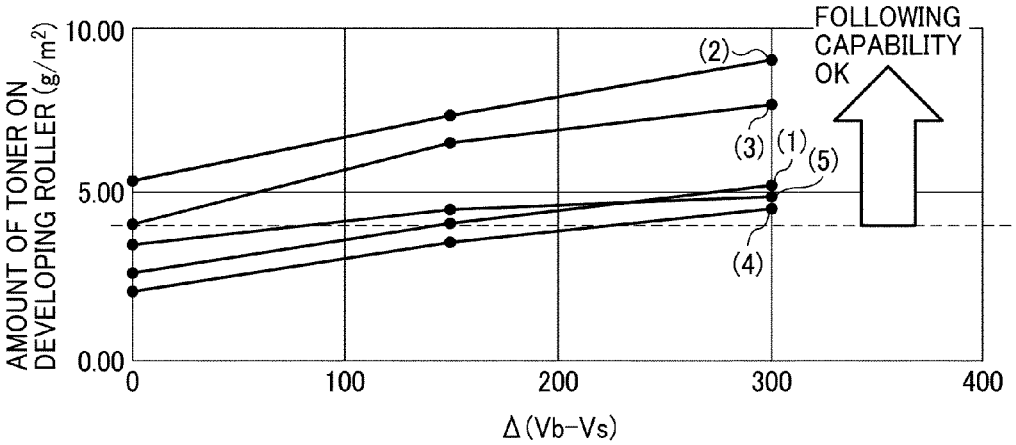
FIG. 3A is a graph showing the relationship between the supply bias offset and the amount of toner on the developing roller.

FIG. 3A is a graph showing the relationship between the supply bias offset and the amount of toner on the developing roller. In FIG. 3A, the supply bias offset Δ(Vb−Vs) is plotted on the horizontal axis (i.e., X axis), and the amount of toner (in units of $g/m^2$) is plotted on the vertical axis (i.e., Y axis).

FIG. 3A illustrates the relationship between the supply bias offset and the amount of toner on the developing roller while changing several parameters, i.e., the photoconductor travel distance, the operation environment (temperature and humidity) of the image forming apparatus, and the continuous operating time of the image forming apparatus. It can be understood from FIG. 3A that as the supply bias offset increases, the amount of the toner electrostatically transferred to the developing roller increases.

At the beginning of the durability test (i.e., when the photoconductor travel distance is 0 m), the amount of toner on the developing roller sharply increases as the supply bias offset increases (i.e., sensitivity of the amount of toner on the developing roller to the supply bias offset is high), as illustrated by the lines (1), (2) and (3) because a film of toner is not formed on the developing roller, and the toner is not deteriorated. In addition, whether or not the toner is easily charged changes depending on parameters including operation environment (temperature and humidity), continuous operating time, and color of the toner used. Therefore, the travel distance of the photoconductor 108, the operation temperature, the operation humidity, the continuous operating time of the developing device, and the color of the toner used are the parameters to be considered when setting of the supply bias offset is performed.

The amount of toner illustrated by a dotted line in FIG. 3A is the minimum amount of toner, above which the toner has good developing roller following capability and therefore low density images are not produced even under a printing condition such that the image density gradation is 100% (i.e., the 255th gradation in a case in which the image density gradation is separated from 0 to 255 gradation). The minimum toner amount illustrated by the dotted line changes depending on factors including the surface conditions (e.g., surface roughness), restraining force, and rotation speed of the developing roller, the ratio of rotation speed of the developing roller to rotation speed of the toner supplying roller, and the diameter of sponge of the toner supplying roller. By properly setting the supply bias offset in consideration of the levels of these factors so that the toner amount on the developing roller is not less than the minimum toner amount illustrated by the dotted line, good developing roller following capability can be imparted to the toner.

Figure 3B:
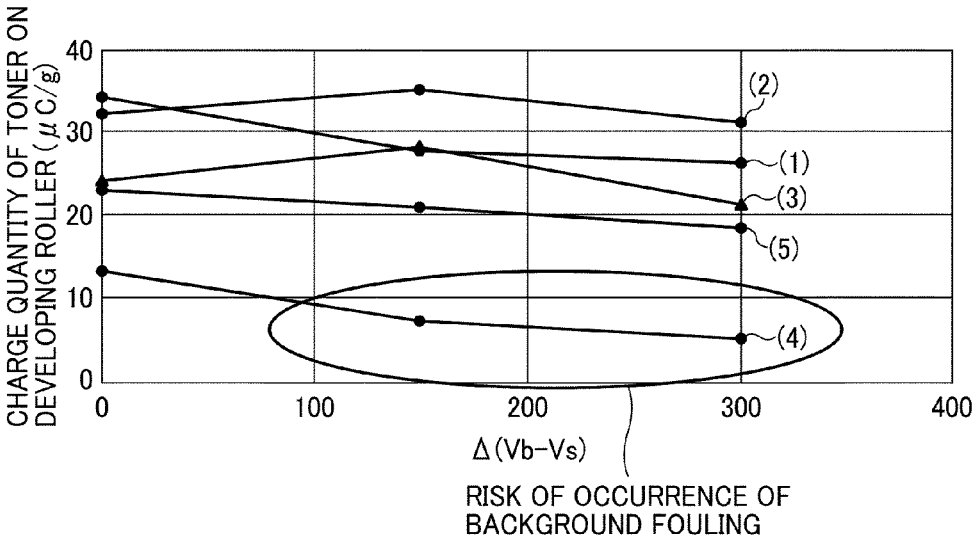
FIG. 3B is a graph showing the relationship between the supply bias offset and the charge quantity (μC/g) of toner on the developing roller.

FIG. 3B is a graph showing the relationship between the supply bias offset and the charge quantity (μC/g) of toner on the developing roller. It can be understood form FIG. 3B that when the supply bias offset increases under a condition (4) such that the photoconductor travel distance is 5000 m, and the evaluation is performed under a high temperature and high humidity condition when the developing device is operated, the charge quantity (μC/g) of toner on the developing roller decreases, thereby increasing the risk of formation of background fouling.

FIG. 3C is a graph showing the relationship between the supply bias offset and the charge quantity ($\mu C/m^2$) of toner on the developing roller. It can be understood form FIG. 3C that when the supply bias offset increases under a condition (2) such that the photoconductor travel distance is 0 m, and the evaluation is performed under a low temperature and low humidity condition after the developing device is left under the low temperature and low humidity condition, the charge quantity ($\mu C/m^2$) of toner on the developing roller increases, thereby increasing the risk of formation of white area development.

Figure 4A:
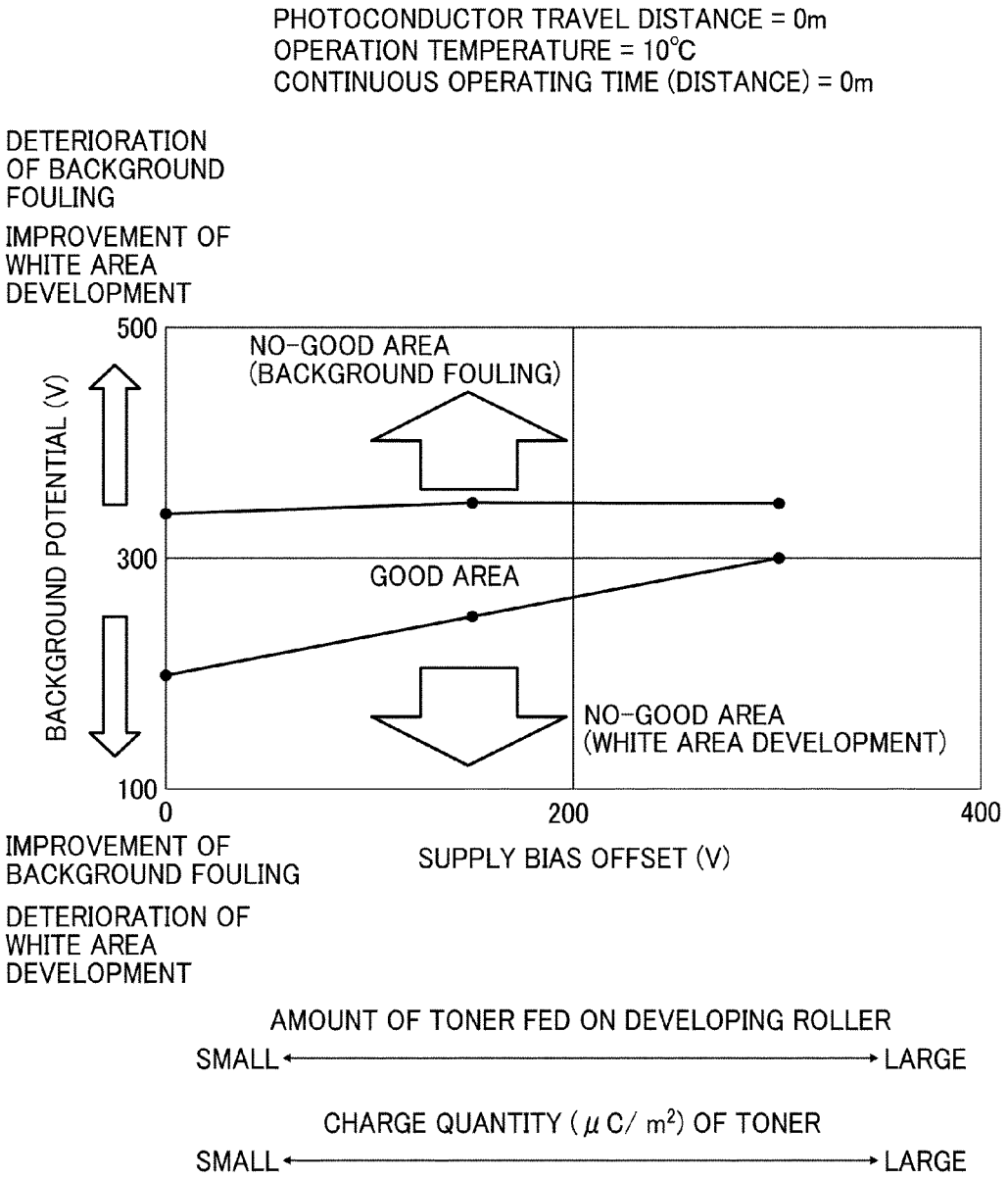
FIG. 4A is a graph showing the relationship among the supply bias offset, background potential, and image quality (i.e., white area development and background fouling) when a new developing device and a new photoconductor are used at 10° C.
Figure 4B:
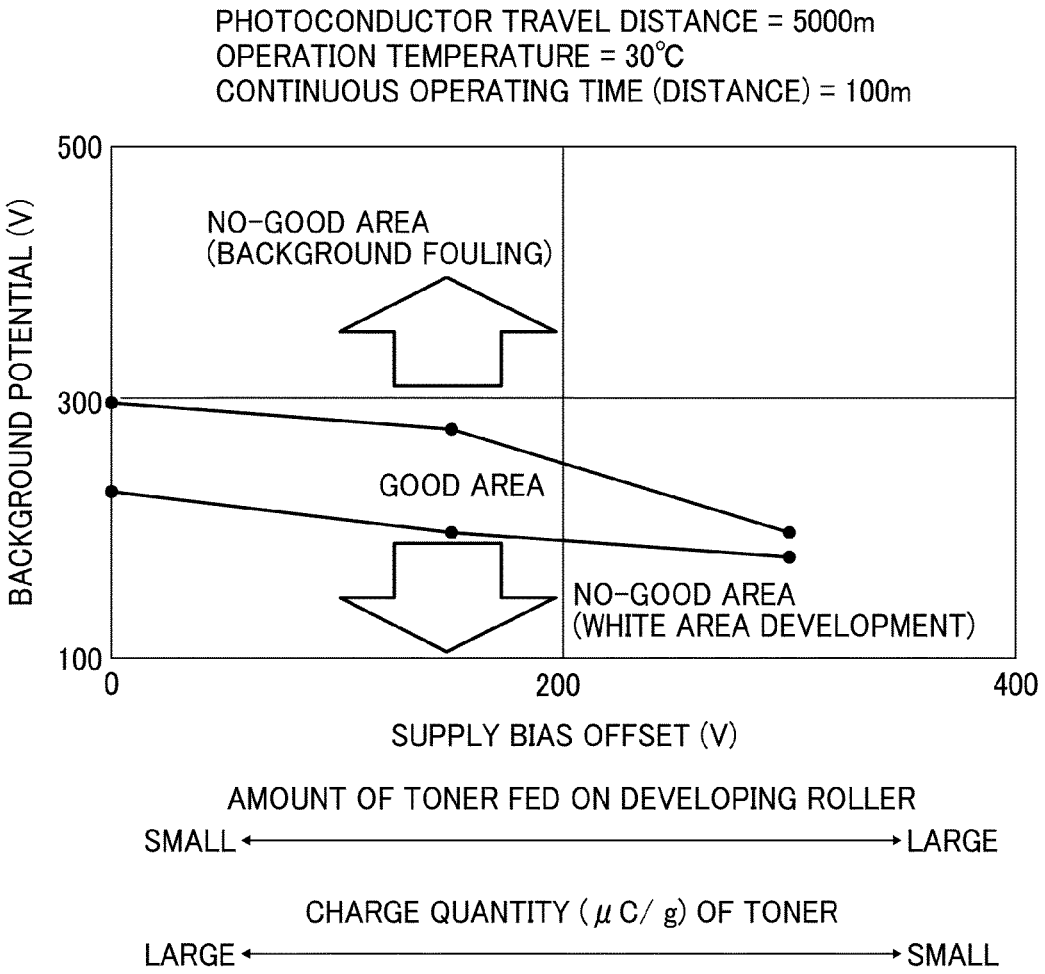
FIG. 4B is a graph showing the relationship among the supply bias offset, background potential, and image quality (i.e., white area development and background fouling) when a developing device and a photoconductor having a travel distance of 5,000 m are used at 30° C.

FIG. 4A is a graph showing the relationship among the supply bias offset, background potential, and image quality (i.e., white area development and background fouling) when a new process unit with a photoconductor travel distance of 0 m is used at an operation temperature of 10° C. FIG. 4B is a graph showing the relationship among the supply bias offset, background potential, and image quality (i.e., white area development and background fouling) when a process unit with a photoconductor travel distance of 5,000 m is continuously operated at a running distance of 100 m at 30° C.

In FIGS. 4A and 4B, the shape of the graphs (i.e., the good area of the image quality) changes depending on parameters including the operation environment (temperature and humidity), photoconductor travel distance, and the continuous operating time. This is because sensitivity of variation of the amount of the toner fed on the developing roller and sensitivity of variation of the toner charge quantity ($\mu C/m^2$, μC/g) against variation of the supply bias offset changes depending on the parameters mentioned above. Since the background fouling and the white area development occur depending on the total charge quantity of the toner (i.e., the product of the amount of toner fed on the developing roller and the charge quantity of the toner), it is necessary to consider both the variation of the amount of the toner fed on the developing roller and the variation of the charge quantity of the toner.

It can be understood from FIG. 4B that as the charge quantity (μC/g) of the toner decreases, background fouling tends to be easily caused. This is because toner particles having charge quantities lower than a threshold value cause background fouling. By controlling the background potential, the level of background fouling can be improved.

It can be understood from FIG. 4A that as the total charge quantity ($\mu C/m^2$) increase, white area development tends to be easily caused. This is because the white area development phenomenon is a phenomenon caused when the effective potential of the developing roller exceeds the potential of the photoconductor. By controlling the background potential, which is defined as the difference between the surface potential of the photoconductor and the development bias applied to the developing roller, the level of white area development can be improved.

Hereinafter, the method for determining the supply bias offset and the background potential will be described by reference to FIGS. 4A and 4B.

(1) Determination of Supply Bias Offset and Background Potential by Reference to FIG. 4A (A) The supply bias offset has the highest priority, and a proper supply bias offset is selected from a good range in which the amount of toner on the developing roller is not less than the value illustrated by the dotted line in FIG. 3A (i.e., the toner has good developing roller following capability). It can be understood from FIG. 3A that the amount of toner on the developing roller is always greater than the value under conditions in that the photoconductor travel distance is 0 m, and the operation is performed after the machine is left under a low temperature and low humidity condition (i.e., line (2)) even when the supply bias offset changes in a range of from 0 to 300V.

(B) It can be understood from FIG. 3C that when the supply bias offset is set to a relatively high value, there is a risk of formation of white area development. Therefore, it is advantageous to set the supply bias offset is set to a relatively low value.

In addition, it can be understood from FIG. 4A that when the background potential is set to a relatively high value, background fouling tends to deteriorate and white area development tends to be improved, and when the background potential is set to a relatively low value, background fouling tends to be improved and white area development tends to deteriorate. In addition, when the supply bias offset increases, white area development tends to be easily formed under conditions in that the photoconductor travel distance is Om, and the operation environment is a low temperature and low humidity environment. Namely, the good area of the background potential narrows as the supply bias offset increases. In contrast, as the supply bias offset decreases, white area development is not easily formed, and the good area of the background potential widens. Therefore, the supply bias offset is set to a relatively low value, and the background potential is set to about 300V.

(2) Determination of Supply Bias Offset and Background Potential by Reference to FIG. 4B (A) The supply bias offset has the highest priority, and a proper supply bias offset is selected from a good range in which the amount of toner on the developing roller is not less than the value illustrated by the dotted line in FIG. 3A. In addition, it can be understood from FIG. 3A that when the supply bias offset increases so as to be about 300V, the amount of toner on the developing roller can become not less than the value (i.e., the toner can have good developing roller following capability) under conditions in that the photoconductor travel distance is 5000 m, and the operation is performed when the machine is operated under a high temperature and high humidity condition (i.e., line (4)). Therefore, the supply bias offset is set to 300V.

(B) It can be understood from FIG. 3B that when the supply bias offset is amount 300V, the charge quantity per unit weight (μC/g) is low and therefore there is a risk of formation of background fouling.

(C) In order to decrease the risk of formation of background fouling, it is necessary to set the background potential to a relatively low value, and therefore the background potential is set to 200V.

In this regard, it can be understood from FIG. 4B that when the supply bias offset is relatively low, width of the good area is relatively large compared to that in a case in which the supply bias offset is relatively high because the risk of formation of background fouling is decreased. However, in order that the toner can maintain good developing roller following capability, it is difficult to use this method.

When the supply bias offset and the background potential are set, the settable area changes depending on parameters including color of toner, travel distance of the developing device (i.e., deterioration of the parts of the developing device), operation environment (temperature and humidity), and continuous operating time. Therefore, the background potential is determined by reference to one or more of these parameters. Specifically, by using a look up table (LUT) or a function in which the relationship among these parameters, the supply bias offset, and the image quality (white area development and background fouling) is specified, the supply bias offset is determined.

(Flowchart of Change of Supply Bias Offset)

Figure 5:
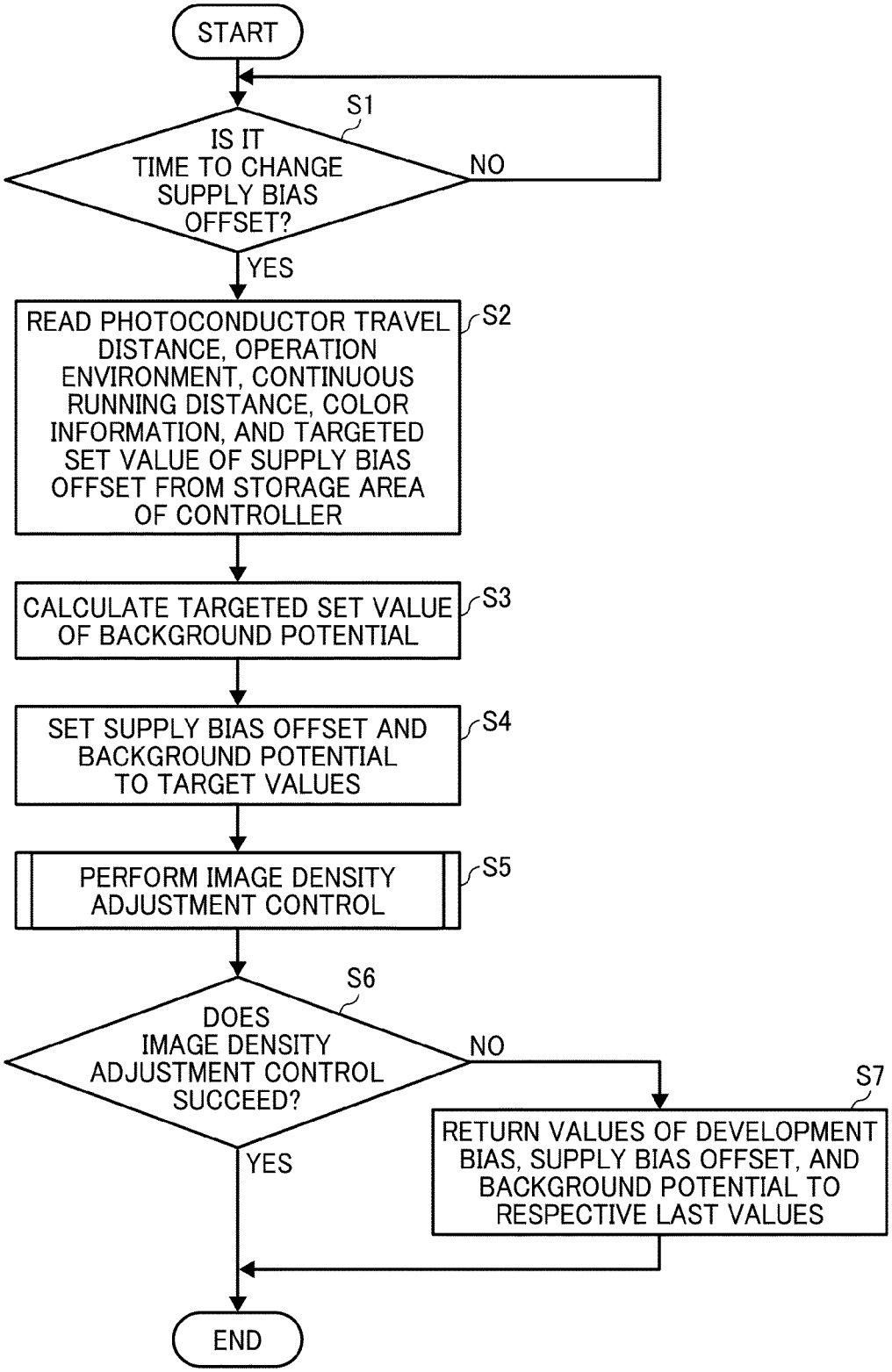
FIG. 5 is a flowchart illustrating a process of from setting of the supply bias offset to image density adjustment control.

FIG. 5 illustrates a flowchart of change of the supply bias offset. In the latter part of this flowchart, image density adjustment is performed to optimize the image density in consideration of the supply bias offset changed.

In step S1 in FIG. 5, it is determined whether it is the time to change the supply bias offset. When the supply bias offset is changed, the image forming apparatus has downtime, i.e., the users cannot perform the copying and printing operations. Therefore, the supply bias offset changing operation is preferably performed at a time in which the supply bias offset changing operation does not interfere the operations of the users, for example, at a warming-up time of the image forming apparatus just after the image forming apparatus is turned on.

When it is the time to change the supply bias offset (yes in step S1), at least two of the parameters including travel distance of the photoconductor 108, operation environment (temperature and humidity), information on color of image, and continuous operating distance are read from the storage area (storage table) of the controller 130 in step S2. In addition, the targeted set value of the supply bias offset is read from the storage area of the controller 130 in step S2. In step S3, the targeted set value of the background potential is determined based on the read parameters. Specifically, by using a look up table (LUT) or a function in which the relationship among these parameters, background potential and image quality (white area development and background fouling) is specified, the background potential is determined. The function is illustrated as graphs in FIGS. 4A and 4B.

In step S4, the supply bias offset and the background potential are set to the target values read from the storage table. After setting of the supply bias offset and the background potential, the image density adjustment control illustrated in FIG. 6 (i.e., formation of image density adjustment patterns and detection of image density of the patterns) is performed in step S5.

The image density adjustment control includes a solid image density adjustment control and a half-tone image density adjustment control, which are the following.

(1) Solid Image Density Adjustment Control

Figure 6:
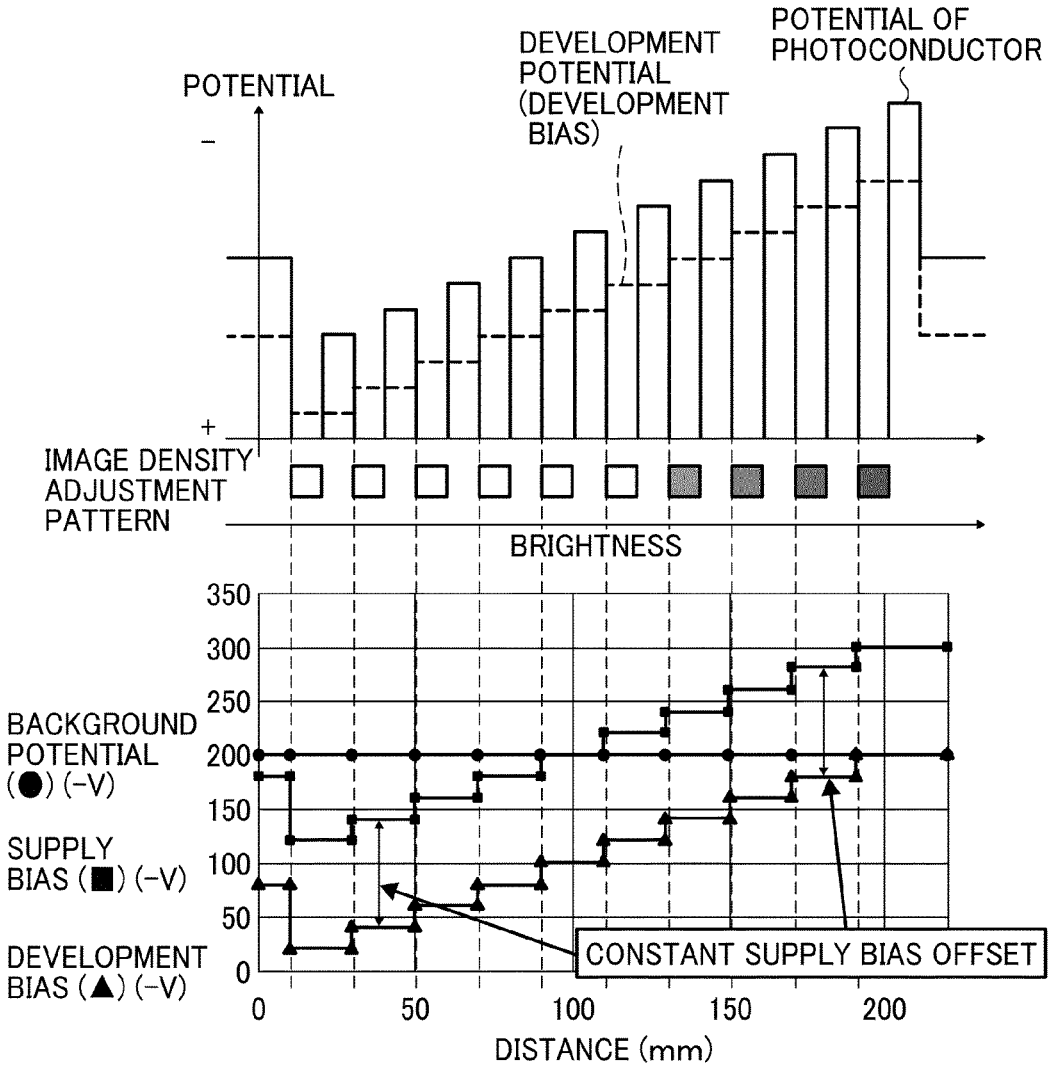
FIG. 6 is a schematic view illustrating an image density adjustment control method.

As described in FIG. 6, toner images are formed on the photoconductor while changing the development bias to determine the proper development bias by which a toner image having the target image density (i.e., target 100% gradation image density) can be produced. In this regard, the charging bias is changed in synchronization with change of the development bias so that the background potential becomes constant, and the energy of light irradiating the photoconductor is not changed.

(2) Half-Tone Image Density Adjustment Control

Half-tone toner images are formed on the photoconductor while changing the energy of light irradiating the photoconductor is changed to determine the proper energy of light. In this regard, the development bias is set to the proper development bias mentioned above in paragraph (1).

This half-tone image density adjustment does not affect the change of the supply bias offset.

In this image density adjustment control, since the background potential is not changed from the value read from the storage table, the background potential is not used as a control factor of the half-tone image density control. Energy of light irradiating the photoconductor 108 is used as a control factor of the half-tone image density control. In step S6, it is determined whether or not the image density adjustment control succeeds. When the image density adjustment control succeeds, i.e., when the targeted half tone images can be formed, the set values of the supply bias offset and the background potential are used without change, and the following sequence is performed.

When the supply bias offset is changed, the amount of toner fed to the developing roller is changed, and the property of the toner on the developing roller 111 is changed for a moment. Therefore, when an image forming operation is performed right after the supply bias offset changing operation, an uneven density image is often formed at the front end of the image. Therefore, it is preferable that when a supply bias offset changing operation is performed, the next supply bias offset changing operation should not performed until the developing roller 111 makes at least one revolution.

When the image density adjustment control fails, i.e., when the targeted half tone images cannot be formed, there is a possibility that the image density of halftone images is not guaranteed. Therefore, in step S7, the values of the development bias, the supply bias offset, and the background potential are returned to the last values at which the image density adjustment control succeeded (i.e., the last values are used again), so that images having image quality similar to the image quality of the images produced after the last image density adjustment control can be produced.

It is possible to provide the controller 130 in each of the process units 102. In this case, the operation described in FIG. 5 can be performed on each process unit, i.e., setting of the supply bias offset and the background potential, and the image density adjustment control can be performed on each process unit.

As mentioned above, the functions of the controller are to occasionally change the supply bias offset so that the toner can be well supplied from the toner supplying roller to the developing roller, and to perform the image density adjustment control after changing the supply bias offset. By performing the image density adjustment control after changing the supply bias offset, occurrence of a problem in that the shade of the image changes can be prevented.

(Specific Example of Image Density Adjustment Control)

FIG. 6 illustrates an example of the image density adjustment control (i.e., solid image density adjustment control). The procedure of the solid image density adjustment control is the following.

(1) The photoconductor 108, which has been charged by a charging bias applied by the charger 110, is irradiated with a light beam emitted by the irradiator 103 to form an electrostatic latent image having one or more patch patterns. The electrostatic latent image is developed with a toner under conditions such that the development bias is −20V and the supply bias is −120V (i.e., the leftmost condition (first condition) in FIG. 6), and the image densities of the developed one or more patch patterns are measured, followed by averaging to determine the average image density under the first condition when plural patch patterns are formed.

(2) The procedure mentioned above in paragraph (1) is repeated except that the charging bias, the development bias and the supply bias are changed while maintaining the supply bias offset (i.e., difference between the development bias and the supply bias) and the background potential (i.e., difference between the surface potential of the photoconductor and the development bias) so as to be constant to determine the image density (or the average image density) under the second and following conditions.

(3) The development bias by which the targeted image density can be obtained is the targeted set value of the development bias.

Namely, this solid image density adjustment control is similar to conventional solid image density control methods except that the supply bias offset and the background potential are maintained so as to be constant.

In this embodiment, in order to prevent formation of background fouling and white area development in the image density adjustment control operation, the values of the supply bias offset and the background potential, which are determined before the image density adjustment control operation, are used during the image density adjustment control operation. Therefore, the image density (image density of solid image) adjustment control can be performed while preventing formation of background fouling and white area development (i.e., preventing failure of the image density adjustment). In this regard, the background potential is controlled by controlling the charging bias applied to the photoconductor 108 and the development bias applied to the developing roller 111.

When the development bias and the supply bias are changed, it is necessary that the difference in voltage (i.e., supply bias offset) between the development bias and the supply bias does not exceed 350V to prevent formation of uneven density images caused by abnormal discharge or leakage current.

(Toner)

Next, the toner for use in the developing device of this disclosure will be described.

The toner is typically prepared by the following method. In the descriptions in the following examples, the numbers represent weight ratios in parts, unless otherwise specified.

[Synthesis of Polyester 1]

The following components were mixed in a reaction vessel equipped with a condenser, a stirrer, and a nitrogen feed pipe.

| | |
|---|---|
| Ethylene oxide (2 mole) adduct of bisphenol A | 235 parts |
| Propylene oxide (3 mole) adduct of bisphenol A | 525 parts |
| Terephthalic acid | 205 parts |
| Adipic acid | 47 parts |
| Dibutyltin oxide | 2 parts |

The mixture was subjected to a reaction for 8 hours at 230° C. under normal pressure.

The reaction was further continued for 5 hours under a reduced pressure of from 10 mmHg to 15 mmHg (1,333 Pa to 2,000 Pa). Next, 46 parts of trimellitic anhydride was added thereto, and the mixture was reacted for 2 hours at 180° C. under normal pressure. Thus, a polyester resin 1 was prepared. It was confirmed that the polyester resin 1 has a number average molecular weight (Mn) of 2,600, a weight average molecular weight (Mw) of 6,900, a glass transition temperature (Tg) of 44° C., and an acid value of 26 mgKOH/g.

[Synthesis of Prepolymer 1]

The following components were mixed in a reaction vessel equipped with a condenser, a stirrer and a nitrogen feed pipe.

| | |
|---|---|
| Ethylene oxide (2 mole) adduct of bisphenol A | 682 parts |
| Propylene oxide (2 mole) adduct of bisphenol A | 81 parts |
| Terephthalic acid | 283 parts |
| Trimellitic anhydride | 22 parts |
| Dibutyltin oxide | 2 parts |

The mixture was subjected to a reaction for 8 hours at 230° C. under normal pressure.

The reaction was further continued for 5 hours under a reduced pressure of from 10 mmHg to 15 mmHg (1,333 Pa to 2,000 Pa). Thus, an intermediate polyester resin 1 was prepared. It was confirmed that the intermediate polyester resin 1 has a number average molecular weight (Mn) of 2,100, a weight average molecular weight (Mw) of 9,500, a glass transition temperature (Tg) of 55° C., an acid value of 0.5 mgKOH/g, and a hydroxyl value of 49 mgKOH/g.

The following components were contained in a reaction vessel equipped with a condenser, an agitator and a nitrogen feed pipe to perform a reaction for 5 hours at 100° C.

| | |
|---|---|
| Intermediate polyester resin 1 | 411 parts |
| Isophorone diisocyanate | 89 parts |
| Ethyl acetate | 500 parts |

Thus, a prepolymer 1 was prepared. The amount of free isocyanate in the prepolymer was 1.53% by weight.

[Preparation of Master Batch 1]

The following components were mixed using a HENSCHEL MIXER mixer to prepare a mixture in which water penetrates aggregates of the pigment (carbon black).

| | |
|---|---|
| Carbon black (REGAL 400R from Cabot Corp.) | 40 parts |
| Polyester resin serving as binder resin (RS-801 from Sanyo Chemical Industries Ltd, acid value of 10 mgKOH/g, weight average molecular weight (Mw) of 20,000, and glass transition temperature (Tg) of 64° C.) | 60 parts |
| Water | 30 parts |

The mixture was kneaded for 45 minutes using a twin roll mill in which the temperature of the surface of the rollers is set to 130° C., and the kneaded mixture was pulverized by a pulverizer to prepare a master batch 1 having a particle size of 1 mm.

[Preparation of Pigment/Wax Dispersion 1 (i.e., Oil Phase Liquid)]

The following components were contained in a reaction vessel equipped with a stirrer and a thermometer.

| | |
|---|---|
| Polyester resin 1 prepared above | 545 parts |
| Paraffin wax | 181 parts |
| Ethyl acetate | 1450 parts |

The mixture was heated to 80° C. while stirred. After being stirred for 5 hours at 80° C., the mixture was cooled to 30° C. over one hour.

Next, 500 parts of the master batch 1, 100 parts of a charge controlling agent (1), and 100 parts of ethyl acetate were added thereto, and the mixture was stirred for one hour. Thus, a raw material liquid 1 was prepared.

Further, 1500 parts of the raw material liquid 1 was fed to another container and subjected to a dispersing treatment using a bead mill (ULTRAVISCOMILL from Aimex Co., Ltd.). The dispersing conditions were as follows.

Liquid feeding speed: 1 kg/hour

Peripheral speed of disc: 6 m/sec

Dispersion media: zirconia beads with a diameter of 0.5 mm

Filling factor of beads: 80% by volume

Repeat number of dispersing operation: 3 times (3 passes)

Next, 425 parts of the polyester resin 1 and 230 parts of ethyl acetate were added to the thus dispersed raw material liquid 1, and the mixture was subjected to the dispersing treatment under the above-mentioned conditions except that the repeated number of the dispersing operation is one. Thus, a pigment/wax dispersion 1 was prepared. The pigment/wax dispersion 1 was diluted with ethyl acetate to have a solid content of 50% by weight, which was measured by heating the liquid for 30 minutes at 130° C.

[Preparation of Aqueous Phase Liquid]

The following components were mixed while stirred.

| | |
|---|---|
| Ion exchange water | 970 parts |
| Resin dispersion serving as a dispersion stabilizer (aqueous dispersion of copolymer of styrene-methacrylic acid-butyl acrylate-sodium salt of sulfate of methacrylic acid ethylene oxide adduct, solid content of 25% by weight) | 40 parts |
| Aqueous solution of sodium dodecyldiphenyletherdisulfonate (ELEMINOL MON-7 from Sanyo Chemical Industries Ltd., solid content of 48.5% by weight) | 140 parts |
| Ethyl acetate | 90 parts |

Thus, an aqueous phase liquid 1, which is a milk white liquid, was prepared.

[Emulsifying Process]

The following components were mixed for 1 minute using a TK HOMOMIXER mixer (from Primix Corp.), whose rotor is rotated at a revolution of 5,000 rpm.

| | |
|---|---|
| Pigment/wax dispersion 1 prepared above | 975 parts |
| Isophorone diamine serving as an amine compound | 2.6 parts |

Next, 88 parts of the prepolymer 1 prepared above was added thereto, and the mixture was mixed for 1 minute using the TK HOMOMIXER mixer, whose rotor is rotated at a revolution of 5,000 rpm. Further, 1,200 parts of the aqueous phase liquid 1 was added thereto, and the mixture was mixed for 20 minutes using the TK HOMOMIXER mixer, whose rotor is rotated at a revolution of from 8,000 to 13,000 rpm while adjusted.

Thus, an emulsion slurry 1 is prepared.

[Solvent Removing Process]

The emulsion slurry 1 was fed into a vessel equipped with a stirrer and a thermometer, and stirred for 8 hours at 30° C. to remove the organic solvent (i.e., ethyl acetate) therefrom. Thus, a dispersion slurry 1 was prepared.

[Washing/Drying Process]

(1) One hundred (100) parts of the dispersion slurry 1 was filtered under a reduced pressure to prepare a cake.

(2) One hundred (100) parts of ion exchange water was added to the cake, and the mixture was stirred for 10 minutes with a TK HOMOMIXER mixer rotated at a revolution of 12,000 rpm, followed by filtering to prepare a cake (a). In this regard, the filtrate had a milk white color.

(3) Nine hundred (900) parts of ion exchange water was added to the cake (a) and the mixture was stirred for 30 minutes with a TK HOMOMIXER mixer rotated at a revolution of 12,000 rpm while applying supersonic vibration thereto, followed by filtering under a reduced pressure to prepare a cake (b). This washing operation was repeated until the electroconductivity of the resultant slurry became not greater than 10 μS/cm.

(4) A 10% aqueous solution of hydrochloric acid was added to the slurry so that the mixture has a pH of 4, and the mixture was stirred for 30 minutes by a stirrer (i.e., three one motor), followed by filtering to prepare a cake (c).

(5) One hundred (100) parts of ion exchange water was added to the cake (c) and the mixture was stirred for 10 minutes by the TK HOMOMIXER mixer rotated at a revolution of 12,000 rpm. This operation was repeated until the electroconductivity of the resultant slurry became not greater than 10 μS/cm. Thus, a filtered cake 1 is prepared.

The filtered cake 1 was dried for 48 hours at 42° C. using a circulation dryer, followed by sieving using a screen having openings of 75 μm to prepare a mother toner 101 (i.e., toner particles). It was confirmed that the mother toner 1 has an average circularity of 0.974, a volume average particle diameter (Dv) of 6.3 μm, a number average particle diameter (Dp) of 5.3 μm, and a Dv/Dp ratio (i.e., particle diameter distribution) of 1.19.

[Preparation of Toner]

The following components were mixed using a HENSCHEL MIXER mixer.

| | |
|---|---|
| Mother toner 1 prepared above | 100 parts |
| Particulate silica (H20TM from Clariant Japan K.K., which has an average primary particle diameter of 12 nm and which is not treated with a silicone oil) | 1 part |
| Hydrophobized silica (RY50 from Nippon Aerosil Co., which has an average primary particle diameter of 40 nm and which is treated with a silicone oil) | 2 parts |

The mixture was then filtered using a sieve having openings of 60 μm to remove coarse particles and aggregates of the toner. Thus, a toner was prepared.

By using a silica including a silicone oil as an external additive of the toner, the life of the process unit 102 can be extended while the cleanability and the image transfer efficiency of the process unit can be enhanced.

Effects of this Disclosure

In the developing device of this disclosure, in order that the toner can have a charge suitable for developing an electrostatic latent image on a photoconductor, the supply bias offset is changed by reference to at least one of parameters including travel distance of the photoconductor, operation temperature of the developing device, operation humidity of the developing device, continuous operating time of the developing device, and color information of image to be produced, and then plural image density adjustment patterns having different image densities are formed on the photoconductor by changing the development bias, followed by setting the development bias based on the image densities of the plural image density adjustment patterns so that the resultant image has a targeted image density. Therefore, formation of abnormal images such as white area development and background fouling can be prevented while maintaining the capacity of toner supply from the toner supplying roller to the developing roller.

Additional modifications and variations of the present invention are possible in light of the above teachings. It is therefore to be understood that within the scope of the appended claims the invention may be practiced other than as specifically described herein.

What is claimed is:

1. An image forming apparatus comprising:

a photoconductor to bear an electrostatic latent image thereon;

an irradiator to irradiate the photoconductor to form the electrostatic latent image;

at least one developing device including:

a rotatable developing roller which is arranged so as to face the photoconductor while bearing thereon a toner serving as a one component developer to feed the toner to the photoconductor to develop the electrostatic latent image with the toner, thereby forming a toner image on the photoconductor;

a development bias applying device to apply a development bias to the developing roller;

a rotatable toner supplying roller to supply the toner to the developing roller;

a supply bias applying device to apply a supply bias to the toner supplying roller; and at least one controller to control the development bias applying device and the supply bias applying device, wherein the at least one controller performs a development control including changing a supply bias offset, which is defined as a difference between the development bias and the supply bias, by reference to at least one of five parameters including photoconductor travel distance, operation temperature of the at least one developing device, operation humidity of the at least one developing device, continuous operating time of the at least one developing device, and color information of the toner image to be produced; then forming plural toner patterns for image density adjustment having different image densities on the photoconductor while changing the development bias, wherein forming the toner patterns for image density adjustment includes forming half-tone toner images by changing irradiation conditions under which the irradiator irradiates the photoconductor, and the development bias while fixing the supply bias offset and a background potential, which is defined as a difference between a surface potential of the photoconductor and the development bias; and setting the development bias to a certain bias based on the image densities of the plural toner patterns so that the toner image produced by the developing device has a targeted image density.

2. The image forming apparatus according to claim 1, wherein the at least one controller controls the development bias applying device and the supply bias applying device in such a manner that the supply bias offset is not greater than 350V when changing the supply bias offset.

3. The image forming apparatus according to claim 1, wherein after the at least one controller changes the supply bias offset, the at least one controller controls the developing roller so as to make at least one revolution before next change of the supply bias offset.

4. The image forming apparatus according to claim 1, wherein when the image densities of the plural toner patterns do not include the targeted image density, the at least one controller returns the supply bias offset and a background potential, which is defined as a difference between a surface potential of the photoconductor and the development bias, to last values.

5. The image forming apparatus according to claim 1, wherein the toner includes, an external additive, a silica including a silicone oil.

6. The image forming apparatus according to claim 1, wherein the at least one developing device is detachably attachable to the image forming apparatus as a process unit.

7. The image forming apparatus according to claim 1, including two or more developing devices, wherein the two or more developing devices form toner images having different colors.

8. The image forming apparatus according to claim 7, further comprising:

two or more controllers to control the development bias applying devices and the supply bias applying devices of the two or more developing devices, respectively, wherein the two or more controllers independently perform the development control for the corresponding two or more developing devices.

9. An image forming method comprising:

forming an electrostatic latent image on a photoconductor;

developing the electrostatic latent image with a toner serving as a one component developer on a rotatable developing roller arranged so as to face the photoconductor, wherein the developing includes:

supplying the toner from a rotatable toner supplying roller to the developing roller while applying a supply bias to the toner supplying roller; and feeding the toner on the developing roller to the photoconductor while applying a development bias to the developing roller; and performing a development control including changing a supply bias offset, which is defined as a difference between the development bias and the supply bias, by reference to at least one of five parameters including photoconductor travel distance, operation temperature of the at least one developing device, operation humidity of the at least one developing device, continuous operating time of the at least one developing device, and color information of the toner image to be produced; then forming plural toner patterns for image density adjustment having different image densities on the photoconductor while changing the development bias, wherein forming the toner patterns for image density adjustment includes forming half-tone toner images by changing irradiation conditions under which the irradiator irradiates the photoconductor, and the development bias while fixing the supply bias offset and a background potential, which is defined as a difference between a surface potential of the photoconductor and the development bias; and setting the development bias to a certain bias based on the image densities of the plural toner patterns so that the toner image produced by the developing device has a targeted image density.

* * * * *